US008585362B2

(12) United States Patent
Horng

(10) Patent No.: US 8,585,362 B2
(45) Date of Patent: Nov. 19, 2013

(54) FAN HOUSING AND HEAT DISSIPATING FAN WITH FAN HOUSING

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 1003 days.

(21) Appl. No.: 12/616,818

(22) Filed: Nov. 12, 2009

(65) Prior Publication Data

US 2011/0108251 A1 May 12, 2011

(30) Foreign Application Priority Data

Sep. 2, 2009 (TW) ..... 98129579 A

(51) Int. Cl.
*F01D 25/24* (2006.01)

(52) U.S. Cl.
USPC ..... 415/215.1

(58) Field of Classification Search
USPC ..... 415/220, 224, 203, 206, 215.1
See application file for complete search history.

(56) References Cited

U.S. PATENT DOCUMENTS

| | | | | |
|---|---|---|---|---|
| 1,978,459 | A | 10/1934 | Hegan | |
| 3,619,088 | A * | 11/1971 | Bullock | 417/363 |
| 3,627,442 | A | 12/1971 | Brandt | |
| 4,199,302 | A * | 4/1980 | Goettl | 415/201 |
| 6,844,641 | B1 | 1/2005 | Horng et al. | |
| 7,604,459 | B2 | 10/2009 | Horng et al. | |
| 8,072,101 | B2 * | 12/2011 | Ho | 310/67 R |
| 2002/0098084 | A1 * | 7/2002 | Gatley, Jr. | 415/206 |
| 2004/0191095 | A1 | 9/2004 | Horng et al. | |
| 2009/0053053 | A1 * | 2/2009 | Lin | 415/206 |
| 2009/0067991 | A1 | 3/2009 | Hwang et al. | |
| 2009/0142190 | A1 | 6/2009 | Horng et al. | |
| 2011/0058938 | A1 * | 3/2011 | Chen | 415/206 |

FOREIGN PATENT DOCUMENTS

| | | |
|---|---|---|
| CN | 1978918 A | 6/2007 |
| TW | 579666 B | 3/2004 |
| TW | 200925842 | 6/2009 |

* cited by examiner

*Primary Examiner* — Nathaniel Wiehe
*Assistant Examiner* — Adam W Brown
(74) *Attorney, Agent, or Firm* — Alan Kamrath; Kamrath IP Lawfirm, P.A.

(57) ABSTRACT

A fan housing includes a plastic casing having a skirt-board and a lateral wall. The skirt-board includes inner and outer peripheries spaced in a radial direction while the plastic casing further includes a first coupling portion formed along the inner periphery of the skirt-board. The lateral wall extends from a face of the skirt-board along the outer periphery of the skirt-board in an axial direction perpendicular to the radial direction. The fan housing includes a metal frame having a shaft coupling member and a second coupling portion. The second coupling portion of the metal frame is coupled to the first coupling portion of the plastic casing. A motor can be mounted to the metal frame of the fan housing, and an impeller can be rotatably coupled to the motor to form a heat dissipating fan.

5 Claims, 8 Drawing Sheets

FAN HOUSING AND HEAT DISSIPATING FAN WITH FAN HOUSING

BACKGROUND OF THE INVENTION

1. Field of the Invention

The present invention relates to a fan housing and, more particularly, to a fan housing including a plastic casing and a metal frame. The present invention also relates to a heat dissipating fan having such a fan housing.

2. Description of the Related Art

Conventional fan housings generally include a base and a lateral wall extending along an outer periphery of the base. The lateral wall includes an air inlet and an air outlet. A motor and an impeller can be mounted to the base to form a heat dissipating fan. The impeller can be driven by the motor to drive in air currents via the air inlet. The air currents exit the air outlet for heat dissipation purposes. The fan housings are generally integrally formed. As an example, the fan housings can be formed of metal, such as aluminum, by integral casting. Although the fan housings made of metal can provide reliable support for the motor and the impeller, the metal fan housings are much more expensive than those made of plastic material. However, the fan housings completely made of plastic material can not provide sufficient structural strength to support the motor and the impeller, resulting in products with poor quality.

A fan housing 9 including a metal frame 91 and a plastic casing 92, as illustrated in FIGS. 1 and 2, has been proposed to solve the disadvantages of conventional fan housings integrally formed of either metal or plastic material. The metal frame 91 includes a fixing portion 911 on an outer periphery thereof. The plastic casing 92 integrally envelopes the fixing portion 911 of the metal frame 91 by injection molding and, thus, forms a lateral wall along the outer periphery of the metal frame 91. The costs can be cut by forming the plastic casing 92 (i.e., the lateral wall) with inexpensive plastic material while the metal frame 91 provides certain structural strength. An example of such a fan housing 9 is disclosed in Taiwan Patent Publication No. 200925842.

It is not uncommon to replace the impeller with a larger or smaller size and to select a motor of an appropriate power in response to differing heat dissipation requirements. The size and shape of the fan housing must be changed accordingly. As an example, when a larger impeller is to be coupled with the same metal frame 91, a compartment defined by the plastic casing 92 formed along the outer periphery of the metal frame 91 after injection molding may be too small to receive the larger impeller. Thus, a manufacturer must prepare metal frames 91 of differing sizes and shapes for use with impellers or motors of differing sizes, resulting in inconvenience in manufacturing of molds and leading to an increase in the manufacturing costs as well as difficulties in stock management.

SUMMARY OF THE INVENTION

An objective of the present invention is to provide a fan housing including a plastic casing and a metal frame, with the size and the shape of the metal frame not changed even though the fan housing is to be coupled with impellers or motors of differing sizes.

The present invention fulfills the above objectives by providing, in a preferred aspect, a fan housing including a plastic casing having a skirt-board and a lateral wall. The skirt-board includes inner and outer peripheries spaced in a radial direction while the plastic casing further includes a first coupling portion formed along the inner periphery of the skirt-board. The lateral wall extends from a face of the skirt-board along the outer periphery of the skirt-board in an axial direction perpendicular to the radial direction. The fan housing includes a metal frame having a shaft coupling member and a second coupling portion. The second coupling portion of the metal frame is coupled to the first coupling portion of the plastic casing.

According to another aspect, a fan housing includes a plastic casing and a metal frame. The plastic casing includes a skirt-board and a lateral wall. The skirt-board includes inner and outer peripheries spaced in a radial direction while the plastic casing further includes a first coupling portion formed along the inner periphery of the skirt-board. The lateral wall extends from a face of the skirt-board along the outer periphery of the skirt-board in an axial direction perpendicular to the radial direction. The metal frame includes a shaft coupling member and a second coupling portion. The second coupling portion of the metal frame is coupled to the first coupling portion of the plastic casing. A motor is mounted to the metal frame of the fan housing. An impeller is rotatably coupled to the motor.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
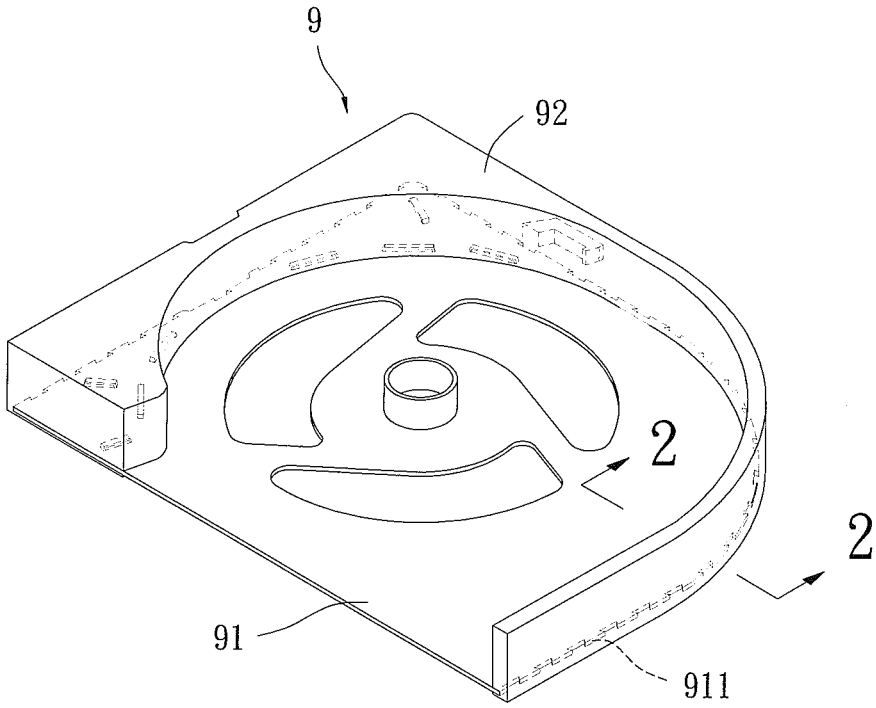
FIG. 1 PRIOR ART
FIG. 1 shows a perspective view of a conventional fan housing.
Figure 2:
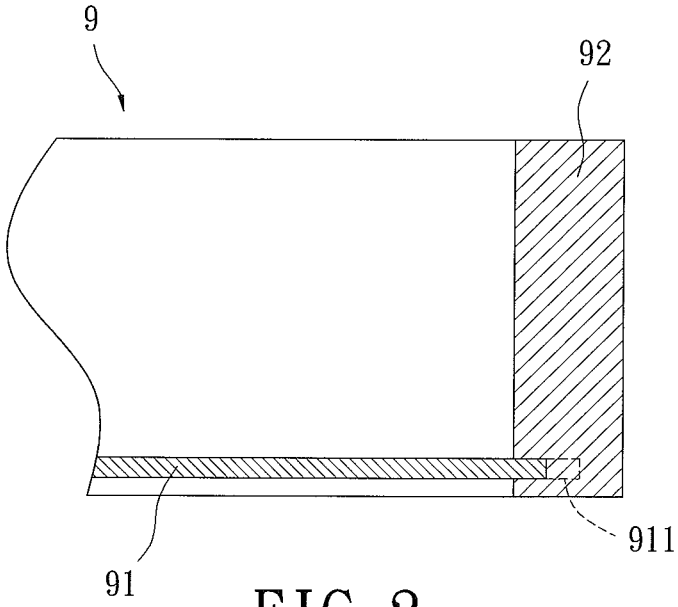
FIG. 2 PRIOR ART
FIG. 2 shows a partial, cross sectional view of the fan housing of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "axial", "radial", "annular", "outward", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 3:
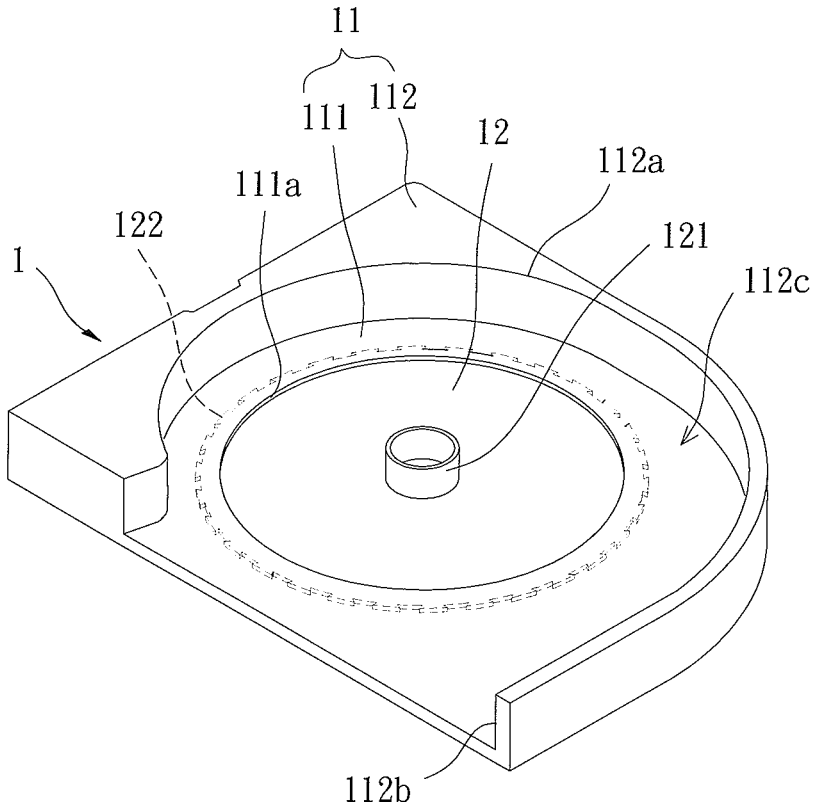
FIG. 3 shows a perspective view of a fan housing of a first embodiment according to the preferred teachings of the present invention.
Figure 4:
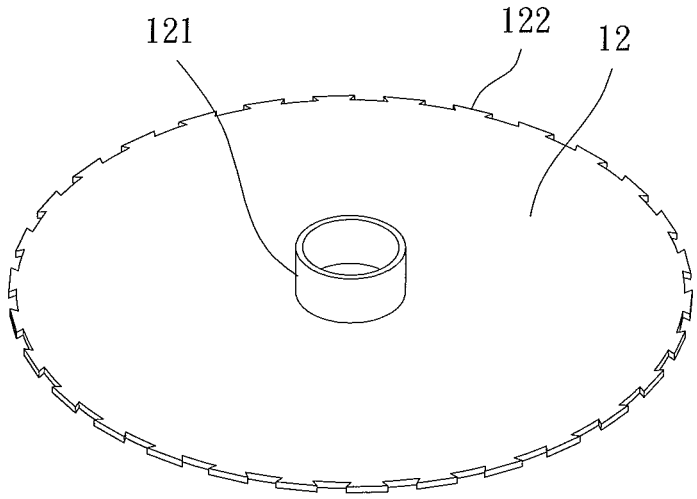
FIG. 4 shows a perspective view of a metal frame of the fan housing of FIG. 3.
Figure 5:
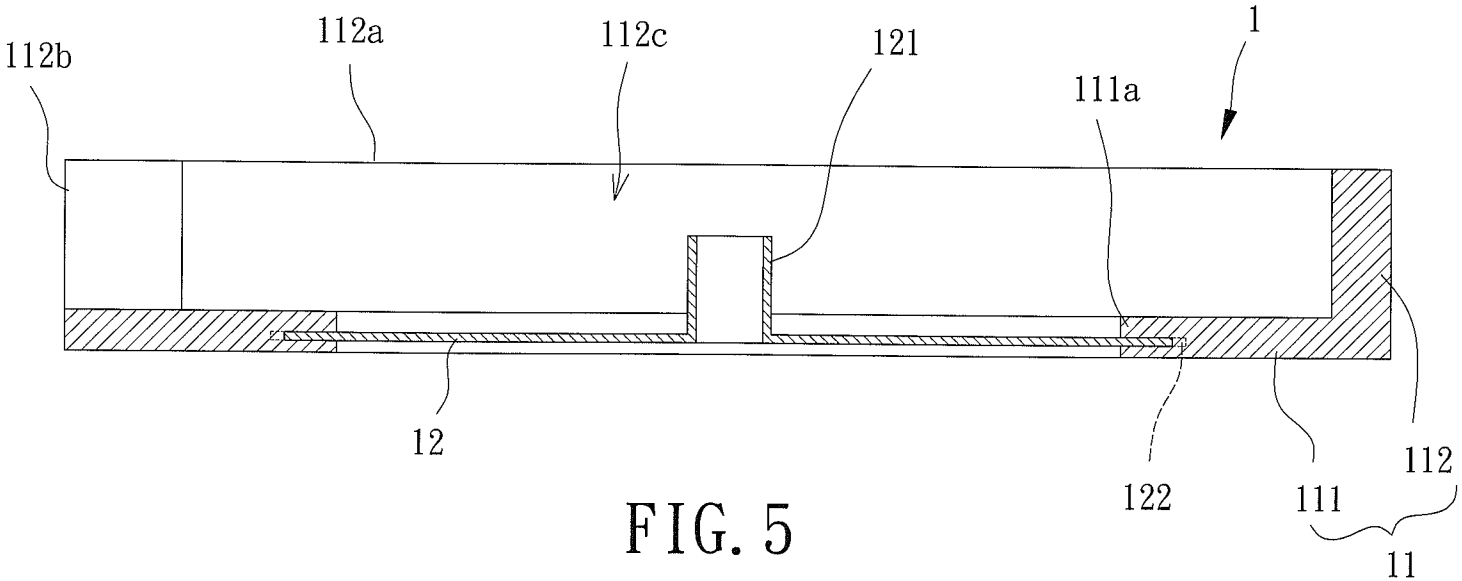
FIG. 5 shows a cross sectional view of the fan housing of FIG. 3.

A fan housing of a first embodiment according to the preferred teachings of the present invention is shown in FIGS. 3-5 and generally designated 1. The fan housing 1 includes a plastic casing 11 and a metal frame 12. The plastic casing 11 can be coupled to the metal frame 12. A fan motor and an impeller can be coupled to the metal frame 12 to form a heat dissipating fan.

Specifically, the plastic casing 11 includes a skirt-board 111 and a lateral wall 112. The skirt-board 111 includes inner and outer peripheries spaced in a radial direction. A first coupling portion 111*a* is formed along the inner periphery. The lateral wall 112 extends from a face of the skirt-board 111 along the outer periphery of the skirt-board 111 in an axial direction perpendicular to the radial direction. The lateral wall 112 includes an air inlet 112*a* and an air outlet 112*b*. The lateral wall 112 defines a compartment 112*c* in communication with the air inlet and outlets 112*a* and 112*b*.

The metal frame 12 includes a shaft coupling member 121 that can be integrally formed on or assembled to a face of the metal frame 12. The shaft coupling member 121 can be in the form of a shaft tube, shaft base, or any structure for coupling with a shaft. The metal frame 12 further includes a second coupling portion 122 formed along an outer periphery or any appropriate location of the metal frame 12 for coupling with the first coupling portion 111*a* of the plastic casing 11. In the preferred form shown, the metal frame 12 is in the form of a disc on which the shaft coupling member 121 is formed. The second coupling portion 122 is formed along an outer periphery of the disc. The outer periphery of the disc is formed with a plurality of notches or the like for coupling purposes.

More specifically, the plastic casing 11 in the preferred form shown is integrally formed by injection molding with the metal frame 12 placed in a cavity of a mold, so that the first coupling portion 111*a* directly envelopes the second coupling portion 122 of the metal frame 12, as shown in FIG. 3. Thus, the plastic casing 11 and the metal frame 12 can be coupled together more reliably. However, the first coupling portion 111*a* of the plastic casing 11 and the second coupling portion 122 of the metal frame 12 can be coupled together by fasteners such as screws, rivets, etc.

Figure 6:
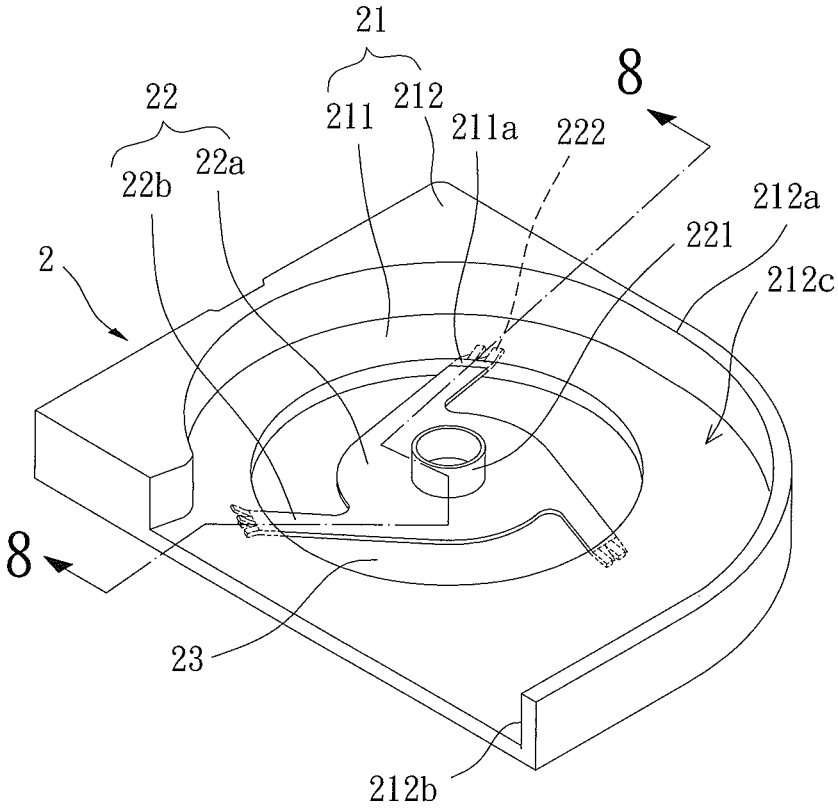
FIG. 6 shows a perspective view of a fan housing of a second embodiment according to the preferred teachings of the present invention.
Figure 7:
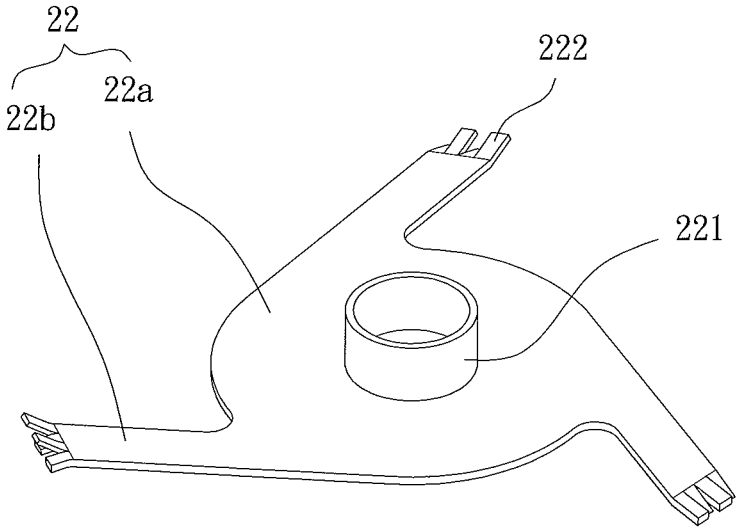
FIG. 7 shows a perspective view of a metal frame of the fan housing of FIG. 6.
Figure 8:
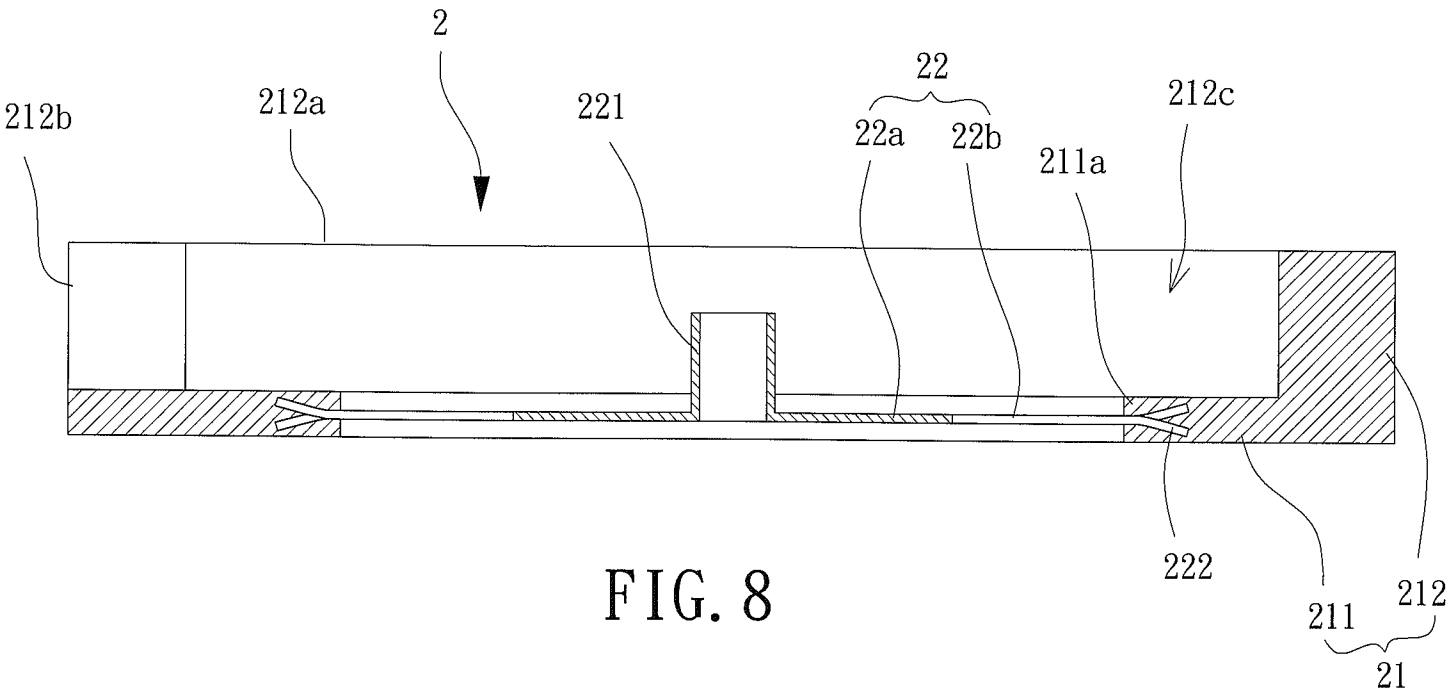
FIG. 8 shows a cross sectional view of the fan housing of FIG. 6 according to section line 8-8 of FIG. 6.

FIGS. 6-8 show a fan housing 2 of a second embodiment according to the preferred teachings of the present invention. The fan housing 2 also includes a plastic casing 21 and a metal frame 22. The plastic casing 21 is the same as the plastic casing 11 of the first embodiment and therefore not described in detail to avoid redundancy. Namely, the plastic casing 21 also includes a skirt-board 211, a first coupling portion 211*a*, a lateral wall 212, an air inlet 212*a*, an air outlet 212*b*, and a compartment 212*c*.

The metal frame 22 of the second embodiment includes a shaft coupling member 221 and a second coupling portion 222. The second coupling portion 222 is coupled to the first coupling portion 211*a* of the plastic casing 21. In this embodiment, the metal frame 22 includes a disc 22*a* and a plurality of ribs 22*b* extending outward from an outer periphery of the disc 22*a*. The shaft coupling member 221 is formed at a center of the disc 22*a*. The second coupling portion 222 is formed on a distal end of each rib 22*b*. The distal end of each rib 22*b* can include a plurality of teeth or similar structure for coupling purposes. Furthermore, some of the teeth can be warped. When the first coupling portion 211*a* of the plastic casing 21 is coupled to the second coupling portion 222 of the metal frame 22 by injection molding, a plurality of auxiliary air inlets 23 is formed between the inner periphery of the skirt-board 211 and the outer periphery of the disc 22*a*, effectively increasing the air inlet amount of the fan housing 2.

Figure 9:
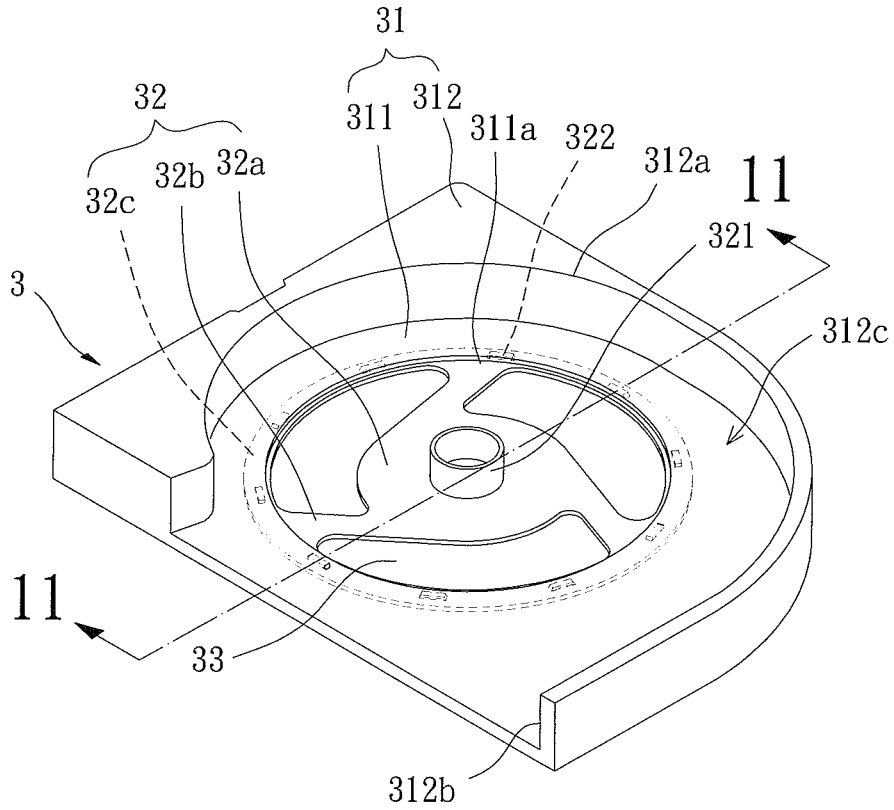
FIG. 9 shows a perspective view of a fan housing of a third embodiment according to the preferred teachings of the present invention.
Figure 10:
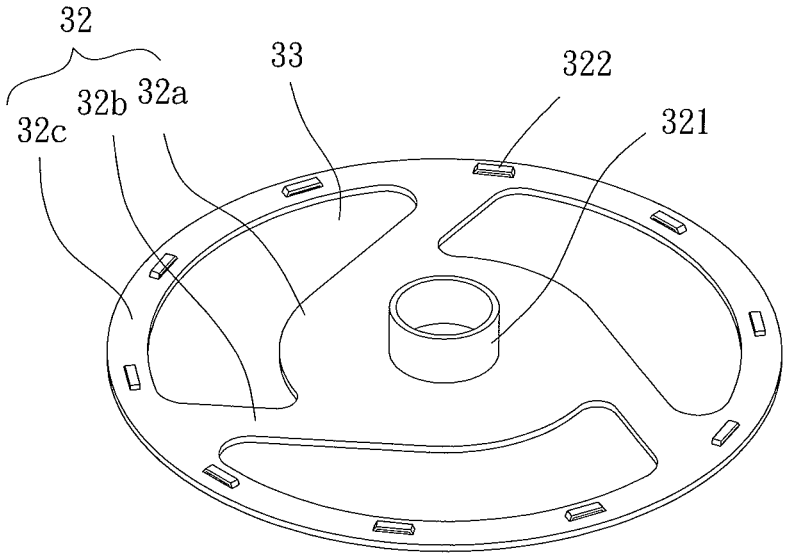
FIG. 10 shows a perspective view of a metal frame of the fan housing of FIG. 9.
Figure 11:
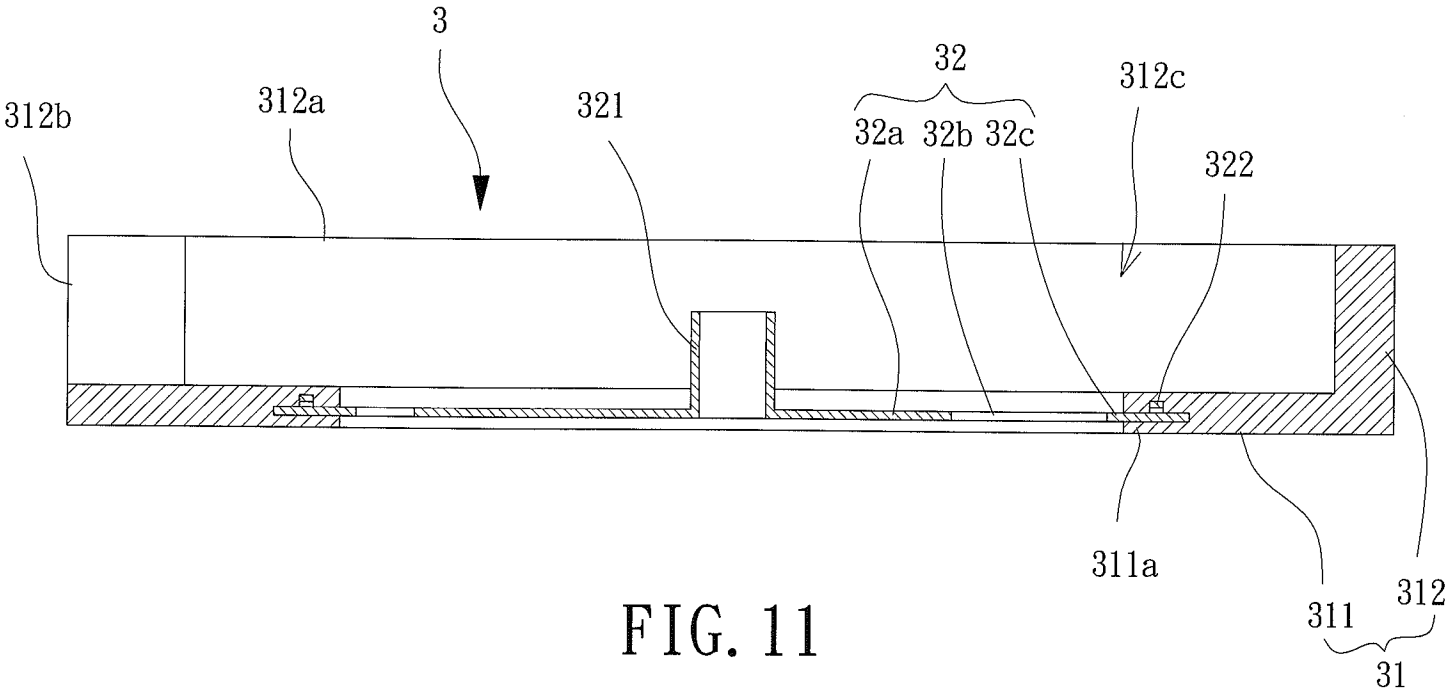
FIG. 11 shows a cross sectional view of the fan housing of FIG. 9 according to section line 11-11 of FIG. 9.

FIGS. 9-11 show a fan housing 3 of a third embodiment according to the preferred teachings of the present invention. The fan housing 3 also includes a plastic casing 31 and a metal frame 32. The plastic casing 31 is the same as the plastic casing 11 of the first embodiment and therefore not described in detail to avoid redundancy. Namely, the plastic casing 31 also includes a skirt-board 311, a first coupling portion 311*a*, a lateral wall 312, an air inlet 312*a*, an air outlet 312*b*, and a compartment 312*c*.

The metal frame 32 of the third embodiment includes a shaft coupling member 321 and a second coupling portion 322. The second coupling portion 322 is coupled to the first coupling portion 311*a* of the plastic casing 31. In this embodiment, the metal frame 32 includes a disc 32*a*, an outer ring 32*c* surrounding and spaced from the disc 32*a*, and a plurality of ribs 32*b* each having a first end interconnected to an outer periphery of the disc 32*a* and a second end interconnected to an inner periphery of the outer ring 32*c*. The shaft coupling member 321 is formed at a center of the disc 32*a*. The outer ring 32*c* forms the second coupling portion 322. Furthermore, the outer ring 32*c* includes a plurality of protrusions on a face thereof. Alternatively, the outer ring 32*c* can include a plurality of through-holes extending from a face through the other face of the outer ring 32*c*. When the first coupling portion 311*a* of the plastic casing 31 is coupled to the second coupling portion 322 of the metal frame 32 by injection molding, a plurality of auxiliary air inlets 33 is formed between the inner periphery of the skirt-board 311 and the outer periphery of the disc 32*a*, effectively increasing the air inlet amount of the fan housing 3.

It can be appreciated that the second coupling portion 122, 222, 322 of the fan housing 1, 2, 3 according to the teachings of the present invention can be in a form other than those shown in FIGS. 3-11 (such as notches in the outer periphery of the disc, teeth on the distal ends of the ribs 22*b*, protrusions on or through-holes in the outer ring 32*c*) for coupling with the first coupling portion 111*a*, 211*a*, 311*a*.

Figure 12:
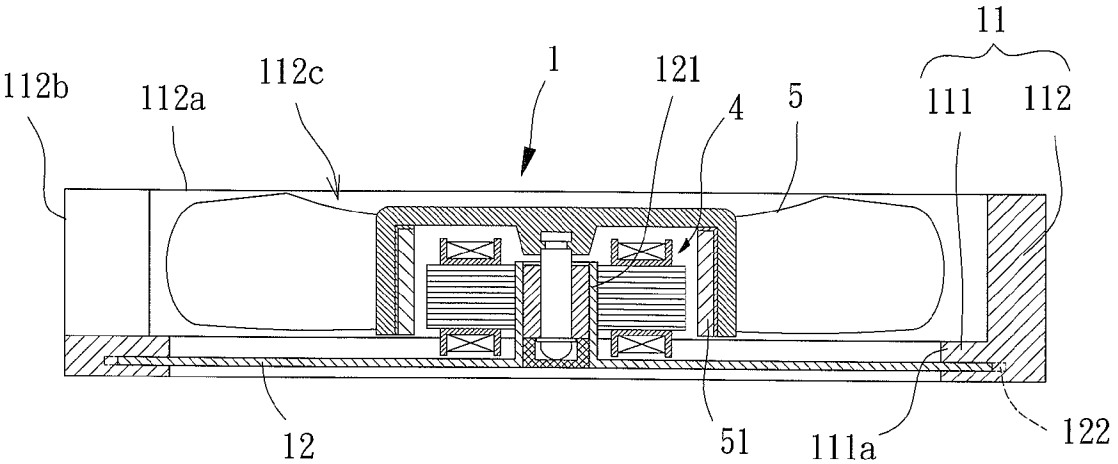
FIG. 12 shows a cross sectional view of a heat dissipating fan including the fan housing of FIG. 3.

The fan housing 1, 2, 3 according to the teachings of the present invention can be utilized in a heat dissipating fan. In an example shown in FIG. 12, a motor 4 and an impeller 5 are mounted to the metal frame 12. The impeller 5 is rotatably coupled to the motor 4, forming a heat dissipating fan. The heat dissipating fan can be mounted in any electronic device or equipment. The impeller 5 drives in air currents via the air inlet 112*a* when the motor 4 drives the impeller 5 to rotate. The air currents exit the air outlet 112*b* for heat dissipation purposes. Furthermore, the impeller 5 includes a permanent magnet 51 aligned with the metal frame 12. Thus, the permanent magnet 51 and the metal frame 12 attract each other in the axial direction during rotation of the impeller 5. Rotational balance and rotational stability of the impeller 5 are, thus, maintained.

Figure 13:
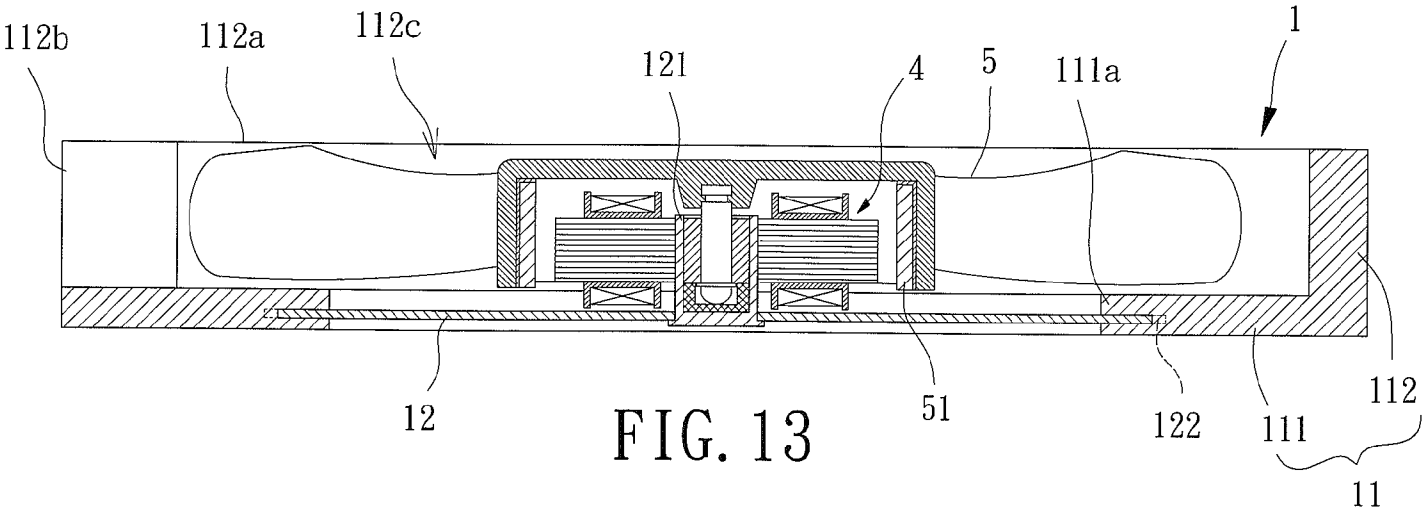
FIG. 13 shows a cross sectional view of a heat dissipating fan including the fan housing of FIG. 3 having a larger skirt-board.

With reference to FIG. 13, in a case that the fan housing 1 is to be utilized with a larger impeller 5 or a larger motor 4, a length of the skirt-board 111 in the radial direction can be increased to form a larger compartment 112*c* for accommodating the larger impeller 5 or motor 4. Namely, the skirt-board 111 of the plastic casing 11 integrally formed around the metal frame 12 is of a larger size corresponding to the larger impeller 5 or motor 4 while the size and shape of the metal frame 12 remains unchanged. Thus, a manufacturer does not have to prepare metal frames 12 of different sizes and shapes even though the size of the impeller 5 or motor 4 is changed.

Conclusively, the material costs and manufacturing costs of the manufacturer can be cut, since preparation of metal frames of different sizes and shapes according to impellers 5 and/or motors 4 of different sizes is not required. Furthermore, the costs and space required for stock are saved, allowing easier stock management. Further, the metal frame 12 provides certain structural strength.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A fan housing comprising:

a plastic casing including a skirt-board and a lateral wall, with the skirt-board including inner and outer peripheries spaced in a radial direction while the plastic casing further includes a first coupling portion formed along the inner periphery of the skirt-board, with the lateral wall extending from a face of the skirt-board along the outer periphery of the skirt-board in an axial direction perpendicular to the radial direction; and a metal frame including a shaft coupling member and a second coupling portion, with the second coupling portion of the metal frame coupled to the first coupling portion of the plastic casing, with the metal frame including a disc having an outer periphery, with the metal frame further including a plurality of ribs extending outward from the outer periphery of the disc and each terminating in a distal end, with the shaft coupling member formed at a center of the disc, with the disc and the plurality of ribs defining a plane, with the second coupling portion formed on a distal end of each of the plurality of ribs and comprising a plurality of teeth, and with one of the plurality of teeth extending in an inclined manner from the plane in a first direction perpendicular to the plane and with another one of the plurality of teeth inclined from the plane opposite to the first direction.

2. The fan housing as claimed in claim 1, with the first coupling portion of the plastic casing enveloping the second coupling portion of the metal frame by injection molding.

3. A heat dissipating fan comprising:

a fan housing including a plastic casing and a metal frame, with the plastic casing including a skirt-board and a lateral wall, with the skirt-board including inner and outer peripheries spaced in a radial direction, wherein the plastic casing further includes a first coupling portion formed along the inner periphery of the skirt-board, with the lateral wall extending from a face of the skirt-board along the outer periphery of the skirt-board in an axial direction perpendicular to the radial direction, with the metal frame including a shaft coupling member and a second coupling portion, with the second coupling portion of the metal frame coupled to the first coupling portion of the plastic casing, with the metal frame including a disc having an outer periphery, with the metal frame further including a plurality of ribs extending outward from the outer periphery of the disc and each terminating in a distal end, with the shaft coupling member formed at a center of the disc, with the disc and the plurality of ribs defining a plane, with the second coupling portion formed on a distal end of each of the plurality of ribs and comprising a plurality of teeth, and with one of the plurality of teeth extending in an inclined manner from the plane in a first direction perpendicular to the plane and with another one of the plurality of teeth inclined from the plane opposite to the first direction;

a motor mounted to the metal frame of the fan housing; and an impeller rotatably coupled to the motor.

4. The heat dissipating fan as claimed in claim 3, with the impeller including a permanent magnet aligned with the metal frame, with the permanent magnet and the metal frame attracting each other in the axial direction.

5. The heat dissipating fan as claimed in claim 3, with the first coupling portion of the plastic casing enveloping the second coupling portion of the metal frame by injection molding.

* * * * *